US007534954B1

(12) United States Patent
Cassista

(10) Patent No.: US 7,534,954 B1
(45) Date of Patent: May 19, 2009

(54) ELECTRIC HARP

(76) Inventor: Philip A. Cassista, 62 Ranger Dr., Hudson, NH (US) 03051

( * ) Notice: Subject to any disclaimer, the term of this patent is extended or adjusted under 35 U.S.C. 154(b) by 0 days.

(21) Appl. No.: 11/490,335

(22) Filed: Jul. 20, 2006

Related U.S. Application Data

(60) Provisional application No. 60/701,454, filed on Jul. 21, 2005.

(51) Int. Cl.
*G10H 3/18* (2006.01)

(52) U.S. Cl. ..... 84/731; 84/730; 84/297 R; 84/297 S

(58) Field of Classification Search ..... None
See application file for complete search history.

(56) References Cited

U.S. PATENT DOCUMENTS

| | | | | | |
|---|---|---|---|---|---|
| 3,049,958 | A * | 8/1962 | Benioff | ..... | 84/731 |
| 4,212,220 | A * | 7/1980 | Helpinstill, II | ..... | 84/726 |
| 4,278,000 | A * | 7/1981 | Saito et al. | ..... | 84/731 |
| 4,796,504 | A * | 1/1989 | McWillis | ..... | 84/265 |
| 5,078,038 | A * | 1/1992 | Clayton | ..... | 84/285 |
| 5,140,883 | A * | 8/1992 | Fay | ..... | 84/266 |
| 5,986,190 | A * | 11/1999 | Wolff et al. | ..... | 84/297 R |
| 6,237,184 | B1 * | 5/2001 | Lenaghan | ..... | 15/210.1 |
| 6,326,532 | B1 * | 12/2001 | Antaki | ..... | 84/377 |
| 6,601,260 | B2 * | 8/2003 | Lenaghan | ..... | 15/210.1 |
| 6,787,688 | B2 * | 9/2004 | Harmos et al. | ..... | 84/291 |
| 6,803,512 | B2 * | 10/2004 | Ishida et al. | ..... | 84/633 |
| 7,015,387 | B2 * | 3/2006 | Chen | ..... | 84/264 |
| 7,038,123 | B2 * | 5/2006 | Ludwig | ..... | 84/723 |
| 7,238,877 | B1 * | 7/2007 | Hosler et al. | ..... | 84/743 |
| 7,273,976 | B2 * | 9/2007 | Bennett | ..... | 84/285 |
| 7,446,255 | B2 * | 11/2008 | Yamaya | ..... | 84/731 |

* cited by examiner

*Primary Examiner*—Marlon T Fletcher

(57) ABSTRACT

An electrified musical instrument having a pickup wire (30), multiple strings (6), and a frame, typically comprising a head (2), diagonal arm (24), front column (16), and rear column (18), arranged in such a way as to provide an electrical signal from vibrations in the strings.

22 Claims, 14 Drawing Sheets

ELECTRIC HARP

CROSS-REFERENCE TO RELATED APPLICATIONS

This application claims the benefit of PPA Ser. No. 60/701,454, filed 2005 Jul. 21 by the present inventor.

BACKGROUND OF THE INVENTION

1. Field of Invention

The invention generally relates to musical instruments, specifically to an improvement to electronically amplified harps.

2. Prior Art

Previously, harps have been electrified by either of two means. Either the soundbox of an acoustic-designed harp would be fitted with an internal microphonic device, or each and every string was fitted with an individually wired microphonic device. Neither of these methods has been altogether satisfactory, since the soundbox approach is highly prone to accidental feedback and player noise pickup, and the individual string approach requires much hand labor and very careful electrical shielding, to avoid pickup of hum by the connecting wires. The individual string approach is also prone to electrical signal "drop-out" of any one of the string microphones due to the high parts count and limited reliability of the method. Both of these prior art methods also suffer from issues of uneven sensitivity. In the soundbox approach, the specific placement of the transducer within the soundbox tends to be oversensitive to some frequencies, and quite insensitive to others. Uneven sensitivity of the individual string approach stems from the manufacturing variation among the microphones, which tend to be hand-made due to the low sales volumes typical of such troublesome instruments, and with the specifics of each microphone's mounting position.

Because electronic amplification and effects are such desirable traits, a rather high percentage of harpers at one time or another will add an audio transducer or microphone to their instrument, if only as a poor compromise to enable them to play in larger venues and be heard at all. These retrofitted acoustic harps, taken in total with soundbox-amplified electric harps, undoubtedly constitute the bulk of electrified or electric harps today. As a result of the simplicity with which acoustic harps can be retrofitted or built with soundbox microphones, there are no preponderant manufacturers of such harps on the world scene.

Prior art manufacturers of soundbox-amplified electric harps currently rely upon well-established designs and methods for creating acoustic harps, to which they merely add in the soundbox microphone system. This results in a hybrid instrument that produces a large volume of acoustic sound (to listeners who are near the performer) as well as the electrical signal, which may be heard by listeners very far from the player. Obviously, if an electrical effect is being applied to the electrical signal (such as chorus, echo, etc), then the nearby listeners will hear a completely different audio performance than the distant listeners. This problem actually can make the player perform more poorly, since the player is not necessarily aware of how the electronically processed signal sounds, and they may not therefore be able to adapt their playing styles to best utilize the effect that has been added.

Soundbox-amplified electric harps also tend to be just as large as their fully-acoustic counterparts, since the acoustic sound of these harps is predominantly what the player hears. Therefore a full-sized soundbox is usually preferred, so that the acoustic sound will not lack bass and be heard as "tinny". As a result of this situation, soundbox-amplified electric harps gain no benefit from the usual miniaturization and reliability that electronics has brought to so many other elements of the modern world.

Soundbox-amplified electric harps are prone to the same variation in tone, even from unit to unit of the same design, due to natural variations in the soundbox wood and unavoidable variation in details of the soundbox construction. As a result, a very high level of craftsmanship is needed to produce a good sound in such instruments.

Soundbox acoustic harps, and also soundbox-amplified electric harps, are unusual instruments in the vibrating-string family in that they rely on a single piece of wood (the soundboard, which is the front of the soundbox) to operate as a structural device against the enormous tension of the strings, and simultaneously as a sensitive acoustic membrane capable of nuanced sound production over the full audio spectrum. Acoustic harps, and also soundbox-amplified electric harps, therefore are prone to cracking or "checking" of the soundboard as it inevitably ages into buzzing uselessness or even complete rupture. Soundbox-based harps are generally not long-lived instruments.

Electric harps built with the individual-string approach are not very common. The leading manufacturers using this technology are Lyon & Healey, with their "Silhouette" harp, Carnac of France, with their "Baby Blue" harps, and some of the electric harps by Kortier. Beyond these three manufacturers, the technology is almost never seen, due to the complexity, low reliability, weight issues, and high cost attendant to the designs.

European and American harps are fully standardized with an offset string plan that produces a very intense twisting force that tends to make these harps curve over to the side that has the strings, with time. To retard this theoretically inevitable phenomenon, these harps and their electrified counterparts are constructed with fairly massive front pillars that have kept harps quite heavy and cumbersome. Even still, the eventual bending and/or breakage of the front pillars of harps is somewhat expected by their owners.

The Paraguayan harp is similar to the Celtic harp but it does make use of a centered-stress design, as does the present invention. As a result, these harps tend to be lighter than their Celtic counterparts. The Paraguayan design, like the Celtic, has tuning pins and/or geared tuning mechanisms located at the top of the strings and an acoustic soundbox located at the bottom of the strings. The soundbox in the Paraguayan harp is subject to the same difficulties and limitations as other soundbox harps, though, and therefore the Paraguayan design has not led to a practical electronic version that addresses the problems mentioned earlier herein.

The electronic harp instrument of Garritano (U.S. Pat. No. 6,787,688) is a complex electronic system involving local oscillators, frequency shifting, etc, which has not met with customer approval. The main concept of the Garritano patent is that the strings will always sound as if "in tune" because the vibrating strings are essentially used as on/off switches for the chromatic sound generation within the electronics of the instrument. This design attempts to provide a solid-body electronic harp-like instrument, but the sound produced by the device is quite divorced from the sound of the strings, due to the many levels of signal processing that is necessarily interposed between the vibrating string and the final output signal. Also, the Garritano invention relies on individual pickups and therefore is subject to many of the flaws and limitations accompanying that method, as detailed earlier herein.

Fishman (U.S. Pat. Nos. 6,239,349 and 6,429,367) discloses a coaxial piezoelectric pickup wire for use with stringed instruments having a saddle or bridge, both of which are lacking in the general harp concept. Turner (U.S. Pat. No. 5,123,325) describes the use of piezoelectric sheet or film located in the saddle slot of the bridge. None of these prior art designs, nor the several others like them, constitute a useful method for practically integrating such pickups into the special geometry of the general harp plan.

Sharping lever inventions by Cunningham (U.S. Pat. No. 6,080,921), Truitt (U.S. Pat. No. 5,796,020), Bunker (U.S. Pat. No. 4,936,182), Fay (U.S. Pat. No. 5,140,883), and others, disclose methods of string sharping that are not efficiently compatible with the layout of the present invention.

OBJECTS AND ADVANTAGES

Accordingly, several objects and advantages of the invention are to describe an electric harp design which is simultaneously reliable, lightweight, low in cost, hum-free, feedback-resistant, and reproducible in quantity without excessive requirements of skill or workmanship.

Further objects and advantages will become apparent from a consideration of the ensuing description and drawings.

SUMMARY

In accordance with the invention, a method and invention are shown by which a reliable, lightweight, low in cost, hum-free, feedback-resistant, and reproducible electronic harp may be made.

DRAWINGS

Figures

Figure 19A:
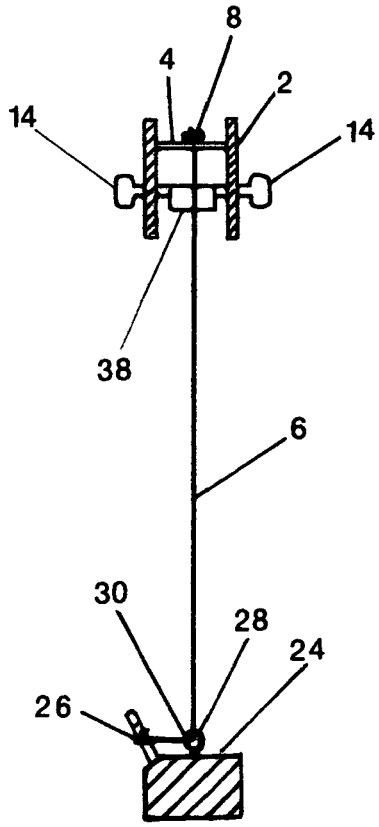
Figure 19B:
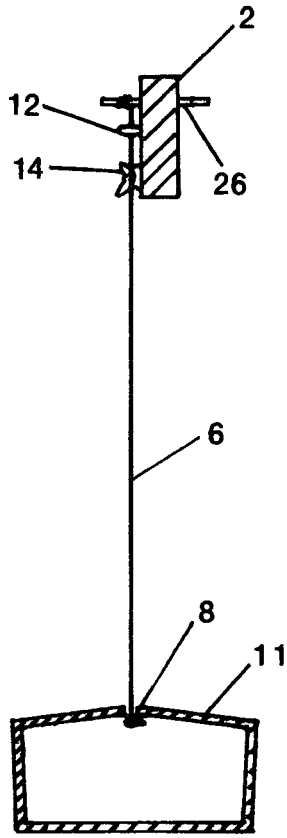
Fig.19B Prior Art
Figure 19C:
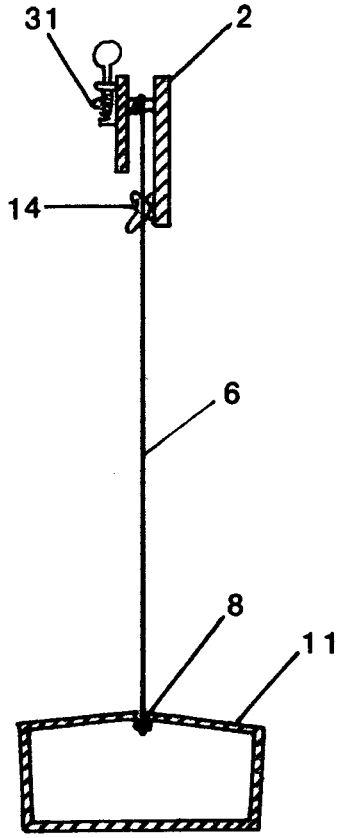
Fig.19C Prior Art
Figure 20:
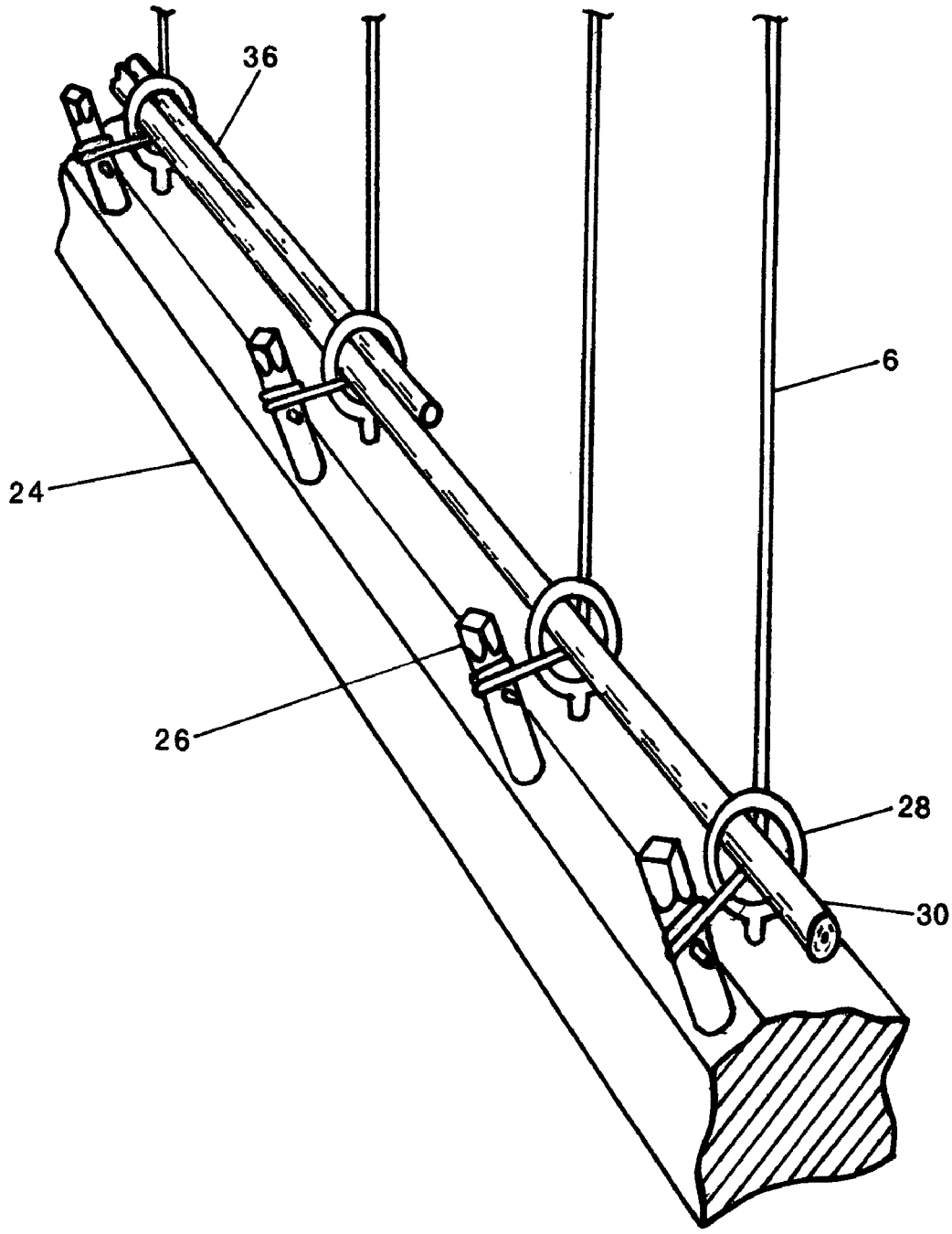
Figure 21:
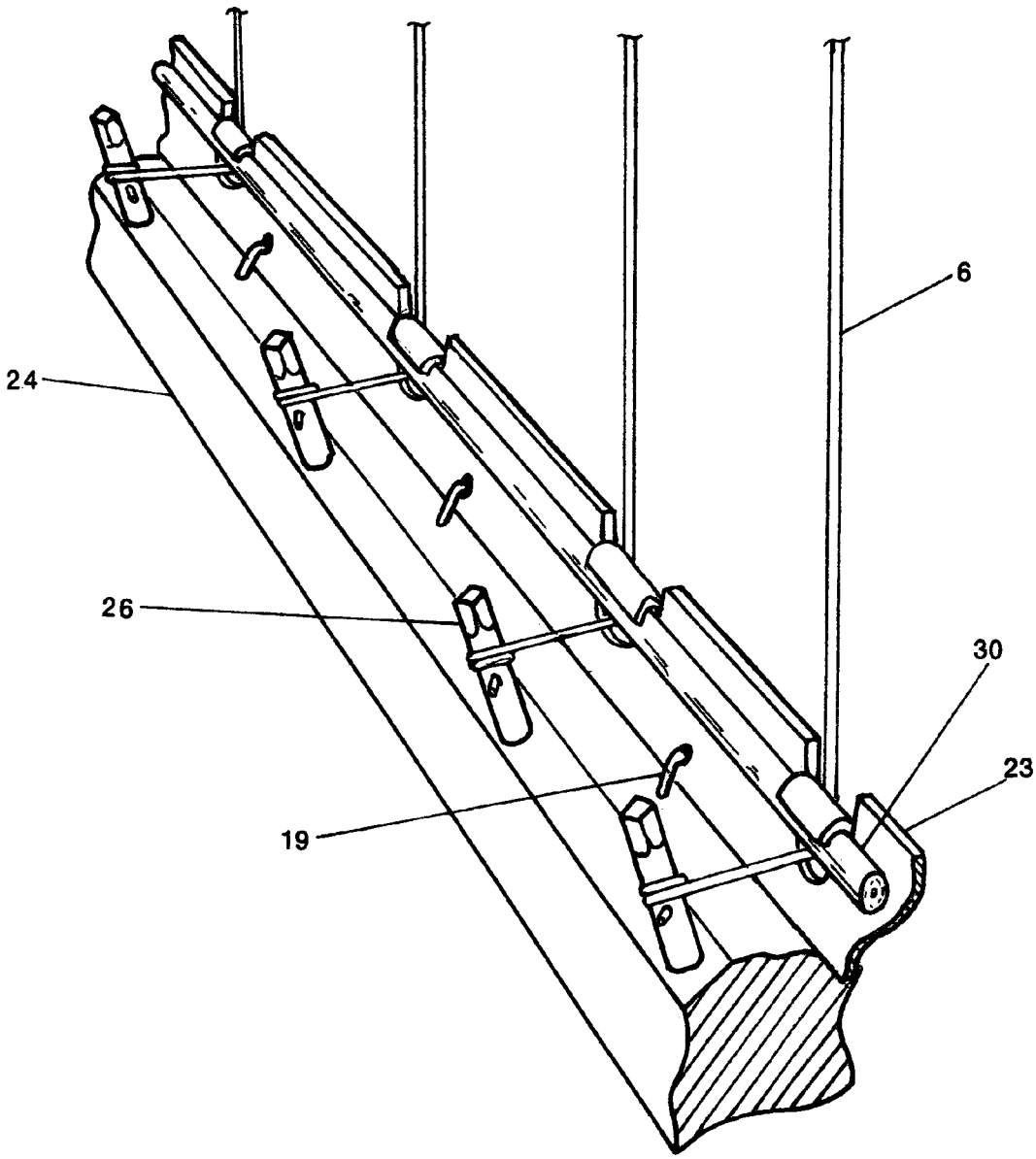
Figure 22:
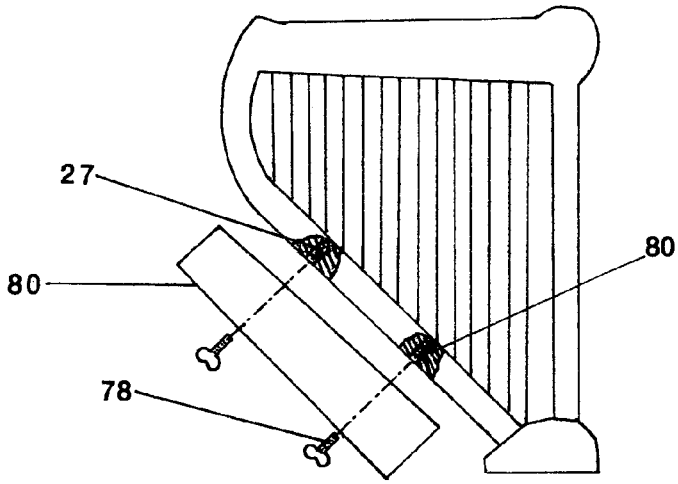
Figure 23:
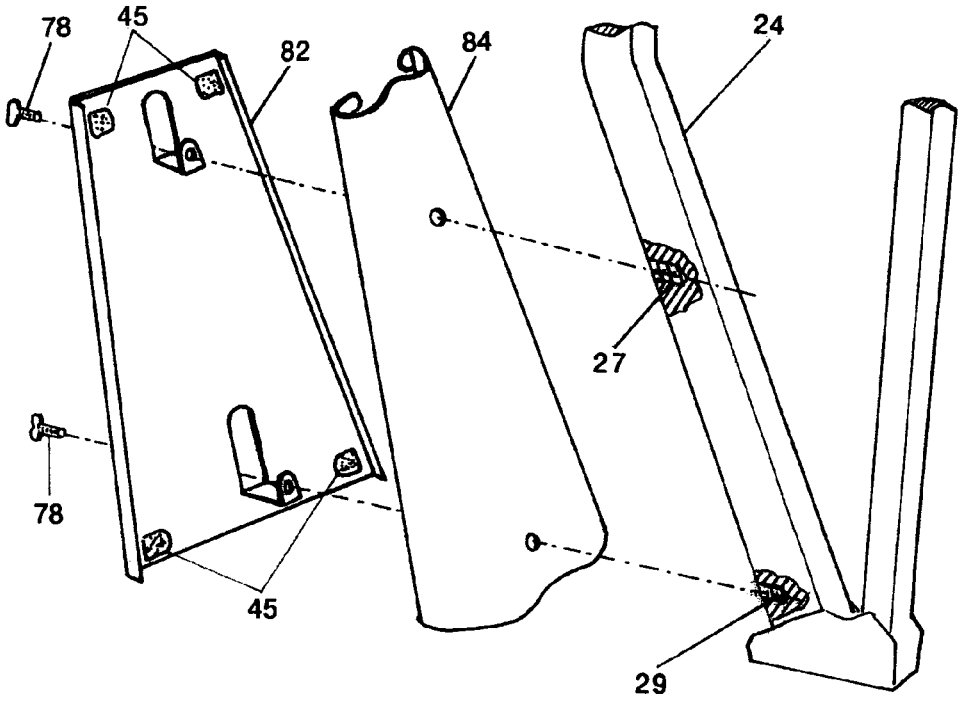
Figure 24A:
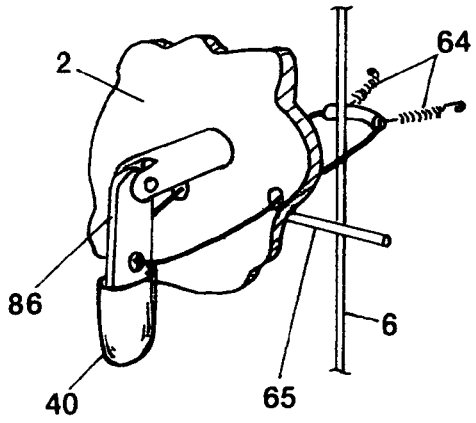
Figure 24B:
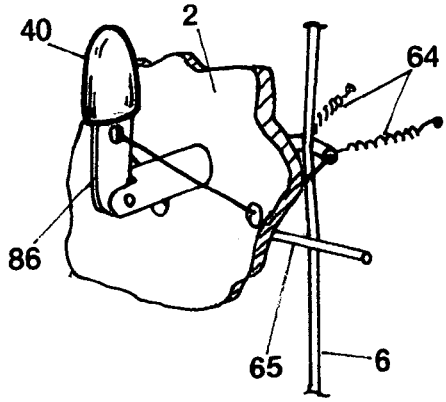
Figure 25A:
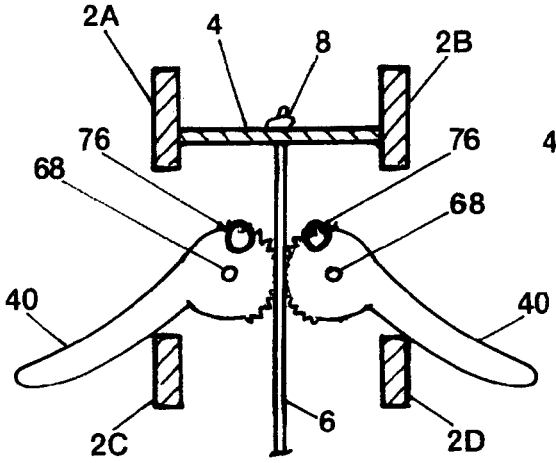
Figure 25B:
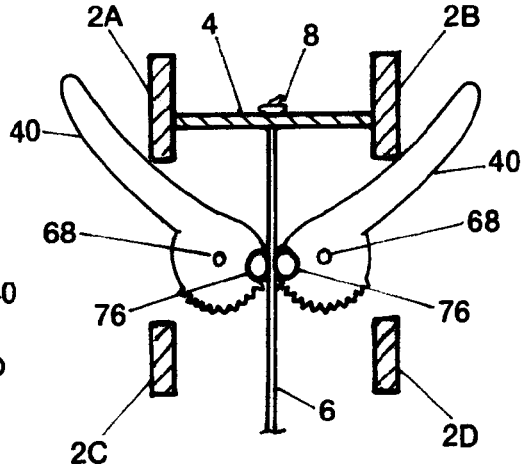

FIG. 19 shows a comparison of the layouts for the present invention and two forms of prior art FIG. 20 shows a detail of the tuner and pickup wire arrangements FIG. 21 shows a detail of an alternative tuner and pickup arrangement to enhance sympathetic resonances FIG. 22 shows the concept of a detachable resonator box FIG. 23 shows a detachable resonator box employing a flexed sheet FIG. 24 shows a lever and cord loop sharper FIG. 25 shows a dual-lever geared sharper

Reference Numerals

1. —
2. Head
3. —
4. String Mount
5. —
6. String
7. —
8. Knot
9. Harmonic Curve
10. Ball End
11. Resonator Box
12. Bridge Pin
13. —
14. Sharper
15. —
16. Front Column
17. —
18. Back Column
19. Loop Mount
20. Pediment
21. —
22. Electrical Connector
23. Perforated Metal member
24. Diagonal Arm
25. Thru Hole
26. Tuning Pin
27. Upper Tapped Hole
28. Lower Fret Loop
29. Lower Tapped Hole
30. Piezoelectric Pickup Wire
31. Geared Tuner
32. Shoulder Rest
33. —
34. Front of Head
35. —
36. Metal Rod
37. —
38. Sharper Body
39. —
40. Sharper Handle
41. —
42. Vibration-absorbing Washer
43. —
44. Shoulder of Handle
45. Hook and Loop Fastener
46. Stop
47. —
48. Slideable Notched Member
49. Rigid Rod
50. Vibration-absorbing Material
51. —
52. Indent
53. —
54. Planar sharper
55. —
56. Magnetic Strip Material
57. —
58. Hinge
59. —
60. Wireform Spring
61. Heavy formed wire
62. Notch

63. —
64. Coil Spring
65. Sharping Ledge
66. Nonresilient Sharping member
67. Ring of Stiffly Resilient Material
68. Pivot
69. —
70. Moveable Bar
71. Decorative Cover
72. Nonrigid Damper Mount
73. —
74. Curved slot
75. —
76. Boss
77. —
78. Thumbscrew
79. —
80. Detachable Resonator Box
81. —
82. Detachable Resonator Back
83. —
84. Semiflexible Resonator Front
85. Non-stretching Cord
86. Hinged Lever
87. Fretting Plates

DETAILED DESCRIPTION

Preferred Embodiment—FIGS. 1,3,4,5&20

Figure 1:
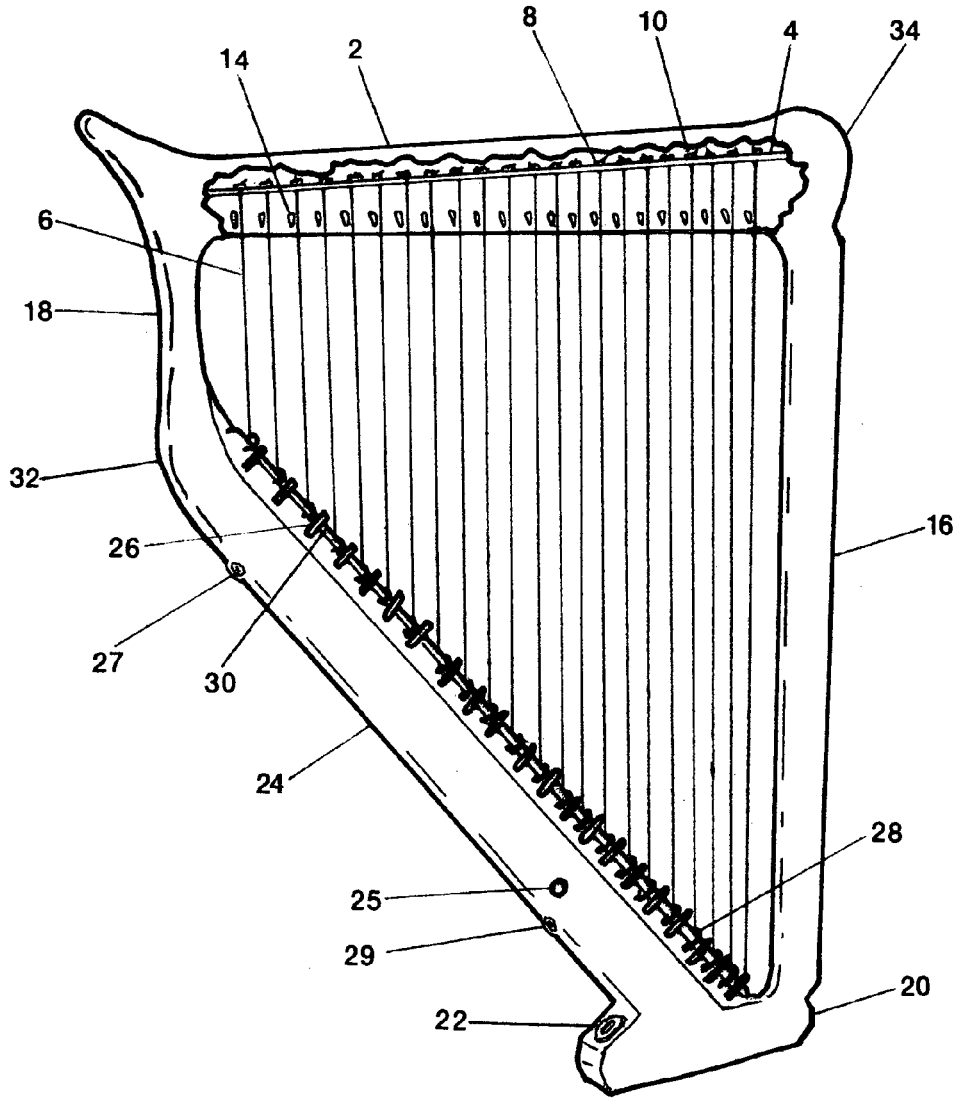
FIG. 1 shows a generalized view of the preferred embodiment of the invention.
Figure 2:
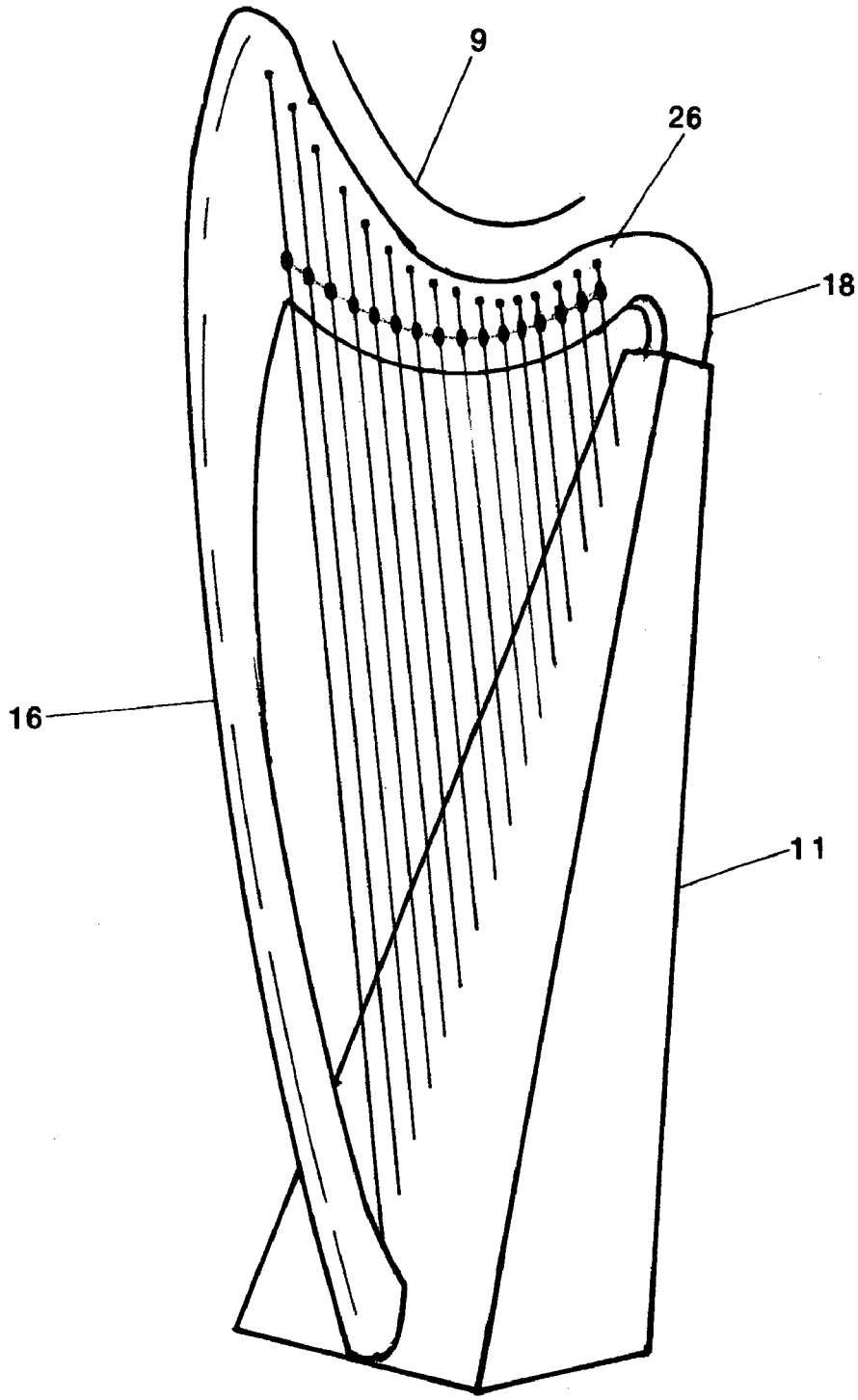
Fig. 2 Prior Art
FIG. 2 shows an example of prior art acoustic harps

FIG. 1 shows a plan view of a basic version of the present invention. The instrument has a head (2), which is a mechanically supporting frame structure which keeps a string mount (4) and a set of sharpers (14) which comprises one or more moveable sharping members, in rigid relative alignment. The string mount is perforated or notched so as to allow set of strings (6) to pass thru with a tight clearance. The tensioned, freely-vibrating musical strings are anchored at the string mount by means of a set of knots (8) or a set of ball ends (10) at the upper end of each string. The strings exert a considerable downward force on the head, due to their tension. This force is taken up by a front column (16), which is connected under the front of the head (34) of the instrument, and a back column (18). In the preferred embodiment, the front column extends downwards to where it connects to a pediment (20), within which is mounted an electrical connector (22). A diagonal arm (24) connects from a shoulder rest (32), at the bottom of the back column, downwards to the pediment. In the preferred embodiment, the diagonal arm is fitted with a set of tuning pins (26) and a set of lower fret loops (28), one set for each of the strings in the instrument. An electrically shielded coaxial piezoelectric cable or wire (30) runs above and parallel to the upper edge of the diagonal arm and passes thru each of the lower fret loops on the diagonal arm. The strings of the instrument also run thru the lower fret loops, where they experience a slight bend as they extend to the tuning pins, where they terminate. The sharpers pass horizontally thru the head, with each sharper in close proximity to its related string. The diagonal arm is also fitted with an upper tapped hole (27), a lower tapped hole (29), and a thru hole (25).

Figure 3:
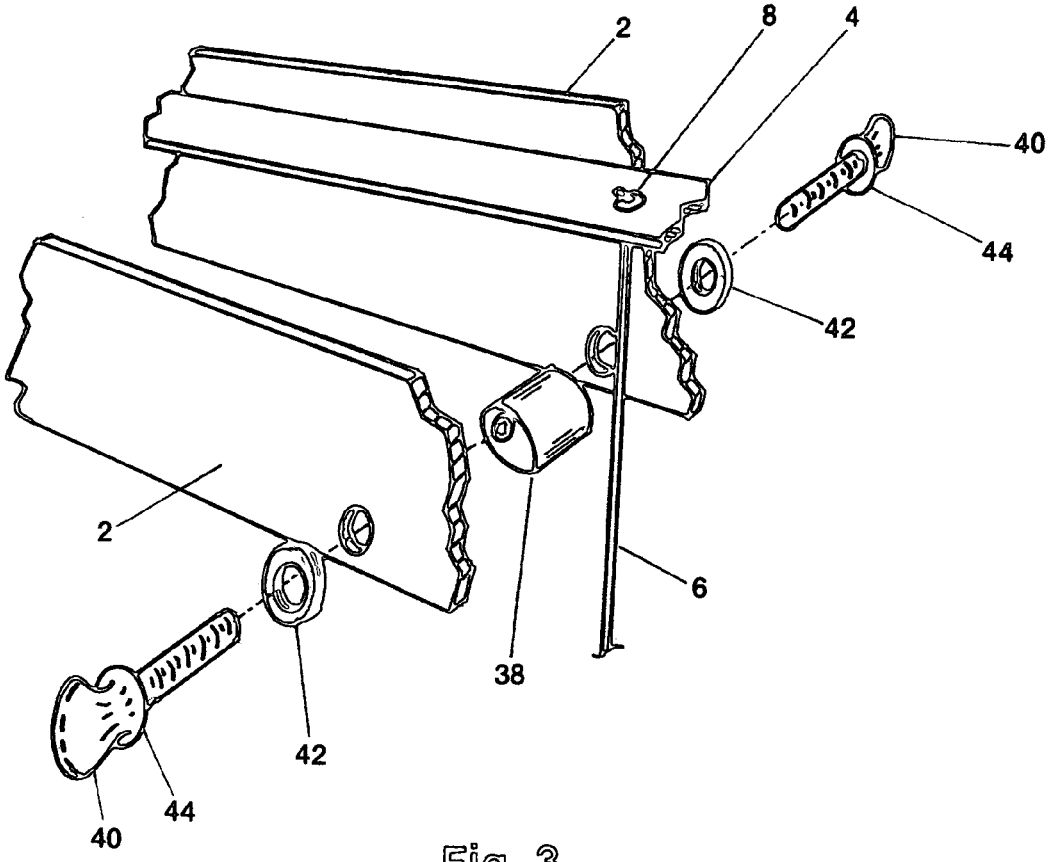
FIG. 3 shows an exploded view of a rotary cam sharper

FIG. 3 shows an exploded view of one of the sharpers of the preferred embodiment. In the preferred embodiment each of the sharpers consists of a sharper body (38) which is rigidly connected to a pair of sharper handles (40), both of which rotatably pass thru a vibration-absorbing washer (42) and thru holes in the sides of the head. Each of the sharper handles has a shoulder (44) that slightly compresses the vibration-absorbing washer against the sides of the head of the instrument.

FIG. 20 shows a detail of the tuner/pickup end of the strings, in which is shown one of the possible orientations of the piezoelectric pickup wire, the tuners, the strings, the lower fret loops, and the diagonal arm. A metal rod (36) is shown emplaced alongside of the pickup wire, and which is held in place against the pickup wire by the tension of the strings that contact it.

OPERATION

Preferred Embodiment—FIGS. 1,3,4,5&20

The head (2) of the instrument is a mechanically supporting structure that keeps a string mount (4) and a set of sharpers (14) in rigid relative alignment. The string mount is perforated or notched so as to allow set of strings (6) to pass thru with a tight clearance. The strings are anchored at the string mount by means of knots (8) or ball ends (10) at the upper end of each string. The holes or perforations in the string mount are drilled in a non-perpendicular orientation relative to the strings of the instrument. This causes the tension of the strings to hold the strings to one side of the hole or perforation, thereby reducing the tendency of plucked strings to buzz against the sides of any oversized holes. In this way, the upper end of the vibrating length of the string is maintained in a very rigid anchor, which may be preferable to the unwanted resilience and/or buzzing of a knot in the string that is captured by a smaller hole, as is common in the prior art.

The piezoelectric coaxial pickup wire (30) runs above and parallel to the upper edge of the diagonal arm (24) and passes thru each of the lower fret loops (28) on the diagonal arm. These loops can be hardware inserted into the frame, or they can be openings, holes, or recesses in at least a portion of said frame, and they are positioned substantially orthogonally to the piezoelectric cable. Each of the strings of the instrument also run thru the lower fret loops, where they experience a slight bend as they extend to the tuning pins (26), where they terminate. In this way, acoustic energy of the vibrations in the strings is coupled into the pickup wire and creates a composite electrical signal output from all of the vibrations of the instrument strings. At the treble end of the pickup wire, where it essentially intersects the back column (18), the end of the coaxial pickup wire is cut and mechanically attached to the back column, to couple additional acoustical signal into the pickup wire, as desired. The piezoelectric cable converts the acoustical signals into an aggregate electronic signal, which is found to be of an appropriate level and impedance to be used with the majority of electronic accessories for electric musical instruments. The continuous coaxial shielding of the piezoelectric cable does not need to be interrupted, as it does in individual-string pickup designs, and so the resulting electrical signal output is highly free of hum or interference pickup.

In the preferred embodiment, the string set consists of typically 18 to 26 strings, as desired. These strings can be made of any of the materials that have been used in the prior art. The use of the metal rod (36) alongside of the pickup wire protects the pickup wire from the higher pressure, per square inch of contact, which can occur with higher density string materials, such as metal strings. Also, it is found that the sustain and clarity of the treble strings can be improved by increasing the rigidity of the bottom end of the vibrating length of the string by use of the metal rod, and that the metal rod can have a circular or noncircular cross-section, as desired, for sonic and/or mechanical stability reasons.

In the preferred embodiment, the front column (16) extends downwards to where it connects to the pediment (20), an optional structure that provides some weight to lower the center of gravity of the instrument, thereby providing greater stability. The pediment also provides a convenient structure in which to locate the electrical connector (22). In the preferred embodiment, the lower end of the pickup wire runs into the pediment, where the signal can be amplified, modified, or controlled by electronics housed within the pediment. Alternatively, the pickup wire can be directly connected to the electrical connector. In the preferred embodiment, this connector is a ¼ inch "guitar jack", which allows the instrument to be used with readily available electric guitar cables, accessories, amplifiers, and effects units, providing the player with a wide array of musical options.

The instrument of the present invention can be played in much the same way as other harps of the prior art. Typically, the harper uses the left hand for the bass strings and the right hand for the treble strings, and the shoulder rest of the instrument contacts the player's right shoulder. The upper tapped hole (27) and lower tapped hole (29), and/or the thru hole (25) in the diagonal arm, facilitate the attachment of brackets and straps that might be desired to keep the harp stably in a playing position. To operate the instrument, a harper would typically draw on their previous experience and training with acoustic harps of traditional design. No especially new method of playing is necessary for the useful operation of the instrument of the instant invention, but with the new design come new options for musical expression.

The sharpers (14), one of which is seen in exploded view in FIG. 3, pass horizontally thru the head, with each sharper in close proximity to it's related string. In the preferred embodiment, the sharper bodies (38) are cam-shaped, independent, and rotatable. In alternative embodiments, the sharper bodies may optionally be caused to be coupled, such that several strings can be sharped with the actuation of a single handle, lever, or etc.

Figure 4A:
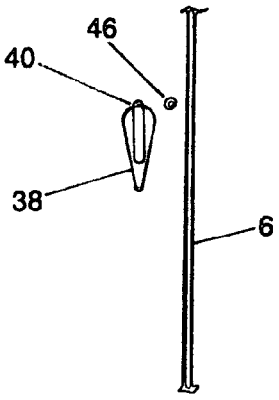
FIG. 4 shows the configuration of a rotary cam sharper
Figure 4B:
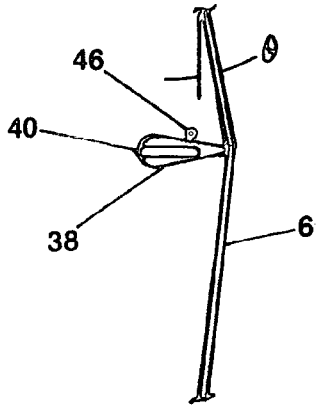
Figure 5A:
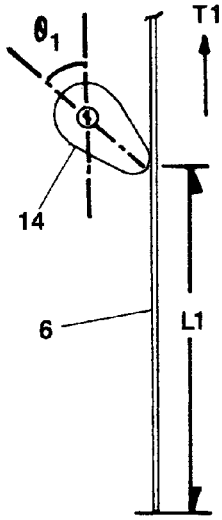
FIG. 5 shows the operation of a rotary cam sharper
Figure 5B:
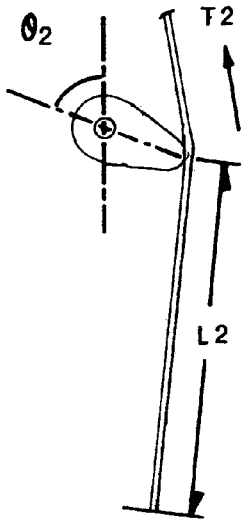
Figure 5C:
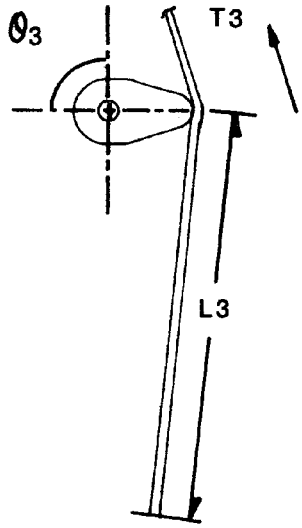

Note that the cam-shaped sharper body is a moveable sharping member which has a suitable opening, hole, or recess which allows said string to pass freely in one position, or to be contacted by the member when it is rotated and/or translated by the operator. The cam-shaped sharper can optionally be replaced by a dowel with a flat cut into one side, or by a bent wire, or any of a number of shapes and materials that would be apparent to one skilled in the art. FIG. 4*a* shows that in one orientation the related string is allowed to pass without contact. By rotating the sharper handle (40) the cam-shaped sharper body is rotated and the pointed end of the cam can be made to fret it's related string, as shown in FIG. 4*b*. The mechanical configuration of the string mount and the set of levers is such that these points of contact occur at a predetermined point along the length of the string to raise the resonant frequency of the string. From the physics of resonantly vibrating strings, it is well known that for any string of given length L, a shortening of the vibrating length by 0.055×L will cause the natural frequency of the string to rise by a musical half-step, such as from C to C#. In the preferred embodiment, the string mount is straight and the length of the strings varies linearly from string to string. Therefore, the half-step point of contact position (which occurs at 0.055×string length) also varies linearly from string to string. As a result of these linear mathematical relationships, there is a straight-line arrangement of the string mount, the sharper positions, and the lower end of the strings that greatly reduces the complexity of the harp design and manufacture. In alternative embodiments, the upper string mount and/or the diagonal arm may have a "C" or "S" curve, which in harping terminology is sometimes referred to as the "harmonic curve" (9), and it is sometimes employed for aesthetic and string-tension benefits. In such embodiments, the position and aggregate curve of the set of sharpers would become a similarly curved line.

Moving parts within a musical instrument can become a source of undesirable buzzes and rattles if they are free to vibrate relative to their supports. In the case of sharpers, however, such a dampening could easily cause a muted sound from a sharped string, if the dampening of the sharper is done incorrectly, since in this condition the upper fret of the string would be at least partially vibration-dampening, greatly reducing the sustain of the sharped strings relative to the longer sustain of the unsharped strings. This is a very undesirable trait of many prior art sharpers. In the preferred embodiment of the present invention, the holes for the sharper mounts are drilled with a loose clearance, to reduce the potential for an objectionable squeak or grind during actuation. The dampening of unwanted sharper vibrations is effected by means compressed resilient materials, such as a vibration-absorbing washer (42) made of rubber or similar material, or constructed as a wave spring etc of resilient material, compressed between a shoulder (44) of the sharper handle and the vertical face of the instrument head. When the sharper cam is rotated into position to push on the string, this pushing force causes the sharper to push back and make good acoustical contact with the far wall of the sharper mounting hole. While trapped in this position of compression between the taut string and the hole wall, the sharper is unable to buzz or vibrate. In this way, the conflicting needs of vibration dampening and good sound transmission are both satisfied.

A review of FIG. 4*b* will show that there is an unavoidable lateral displacement of the string when the sharper is actuated to contact the string, causing a small string angle Theta. In practice it is found that this effect does not produce a discernible pitch error. Still, if so desired, the 0.055 sharper positioning factor can be slightly reduced to counteract any such effect. In the simplified preferred embodiment, there is no detent or stopping means that would position the sharper at a repeatable position on the string. With this detent left out of the design, it is found that the sharped pitch of the strings tends to be surprisingly independent of the angular position of the sharper for the range identified in FIG. 5. This is due to the fact that with increasing Theta (theta 1 thru theta3), the vibrating length of the string (L1 thru L3) increases (which tends to lower the pitch) while the tension in the string (T1 thru T3) increases (which tends to raise the pitch of the string). As a result of these two conflicting tendencies, the sensitivity of pitch versus sharper position is made negligible in most cases.

Since, in the embodiment shown herein, the sharper handles are accessible from both sides, the harper is given new freedom to actuate the sharpers with either hand. In this way musical passages can be played on this instrument that cannot be played on instruments of the prior art. Additionally, the handles as shown can all be located in a straight line above the eye view of the harper. In prior art designs, the sharping levers are typically located along an "S" curve (the harmonic curve) and the harper's view of many of the levers is obscured by this geometry.

DESCRIPTION AND OPERATION OF ALTERNATIVE EMBODIMENTS

FIGS. 6 Thru 18, 21 Thru 25

Figure 6A:
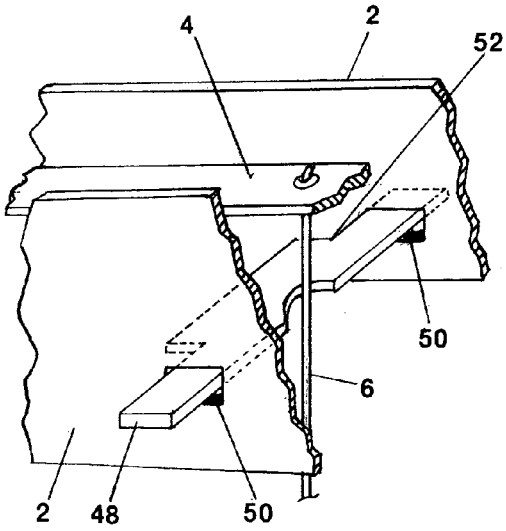
FIG. 6 shows a sliding sharper
Figure 6B:
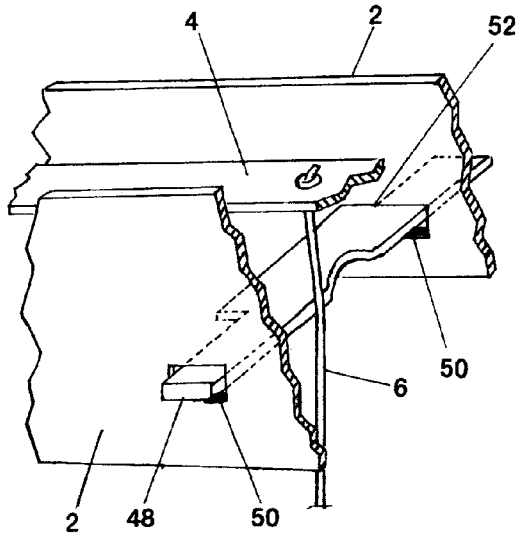

An alternative means of sharping the strings is shown in FIG. 6*a*, in which a slidable notched member (48) is mounted orthogonally to the strings and the string support, in essentially the same position as the cam-shaped portion of the rotary sharpers shown in FIG. 3. To actuate the sharper, the harper merely pushes on the protruding end of the sliding member, which then frets the string as shown in FIG. 6*b*. The sliding member will then be held in place by the contact friction against the wall of the instrument head. Vibration dampening material (50) can be used on the underside and/or the top of the slot thru which the sliding member moves.

Note that indents (52) and/or bumps introduced at the contacting surfaces, or in the rubber material, can be used as detents to the rotation or translation of the sharper, aiding the user in switching between the two modes of operation. Alternatively, stops can be added to the handles and/or the face of the head, which can provide a similar service to the user by limiting the travel of the sharper handle appropriately.

Figure 7A:
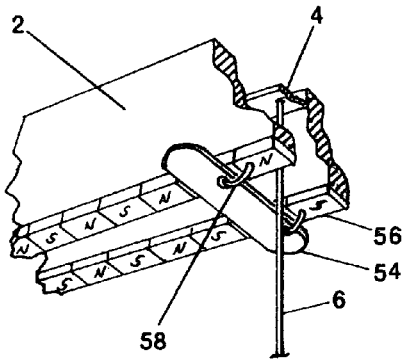
FIG. 7 shows a magnetic sharper
Figure 7B:
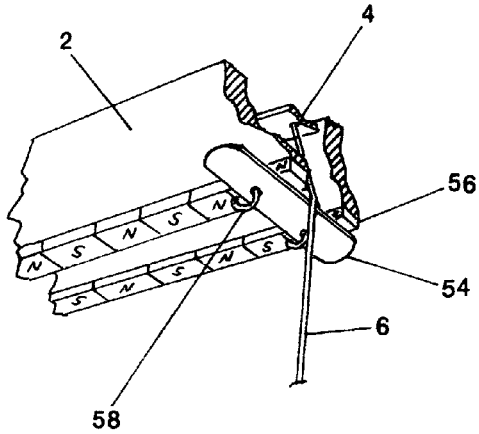

As shown in FIG. 7*a* and FIG. 7*b*, the sharpers can be magnetically held in place, to eliminate vibrations and to provide a mechanical detent. A planar sharper (54) can be made of magnetic material and either be used in a hinged mode or a sliding mode when surrounded by appropriately polarized objects, such as the magnetic strip material (56) shown in FIG. 7*a* and FIG. 7*b*. In FIG. 7*a*, north-south polarization nomenclature is shown overlaid on the magnetic strip material, to aid in clarity. The planar sharper is shown attached to the underside of the head (2) by means of a hinge (58), which may be a "live" hinge of flexible material, or a mechanical hinge design. Note that the planar sharper is stably held in either of two positions by the action of the magnetic strip material. Optionally, simple mechanical features such as steps or recesses can additionally help to restrain the sharper in either or both positions. In the position shown in FIG. 7*a*, the string passes without contacting the sharper, while in FIG. 7*b*, the sharper contacts the string and causes the pitch to raise a half-step.

Figure 8A:
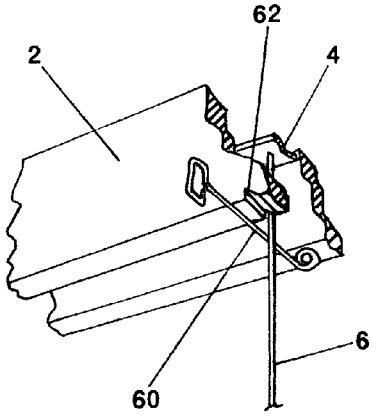
FIG. 8 shows a spring wire sharper
Figure 8B:
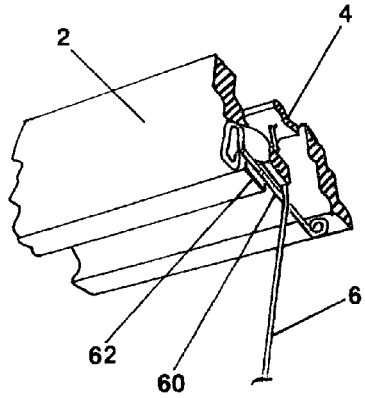
Figure 9A:
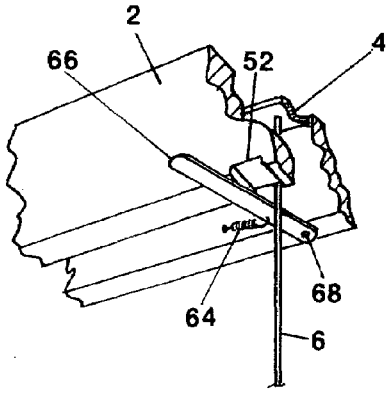
FIG. 9 shows a spring-connected nonresilient sharper
Figure 9B:
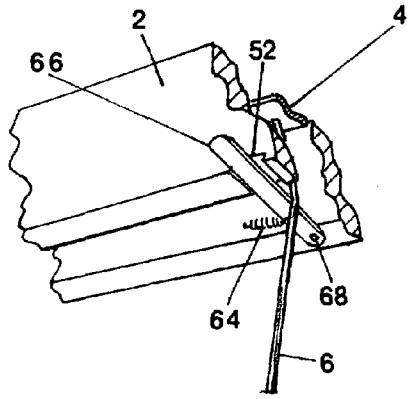

Another sliding planar sharper can be created from resilient sliding or rotating members that are maintained in either of their two stable positions, and not allowed to vibrate, by their resilience. This resilience can be caused by using spring metal for the sharping member, as shown in FIG. 8*a* in which the resilient wire spring (60) is shown as being held in contact with the underside of the head by the spring force in the wire spring. FIG. 8*b* shows the sharped position, in which the wire spring is shown held in a taut position within a notch (62) on the underside of the head or as shown in FIGS. 9*a* and 9*b*, by using elastomeric material or a coil spring (64) to apply resilient force to an otherwise nonresilient sharping member (66) mounted on a pivot (68), among other possibilities.

Figure 11:
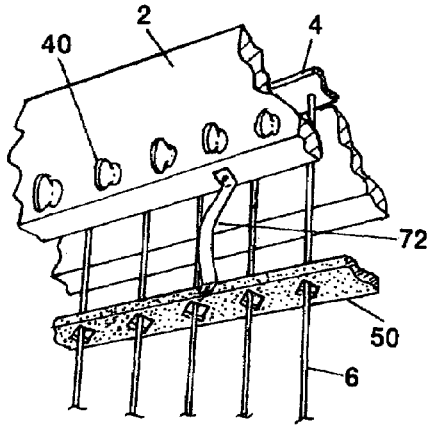
FIG. 11 shows a thru-mounted damper
Figure 13:
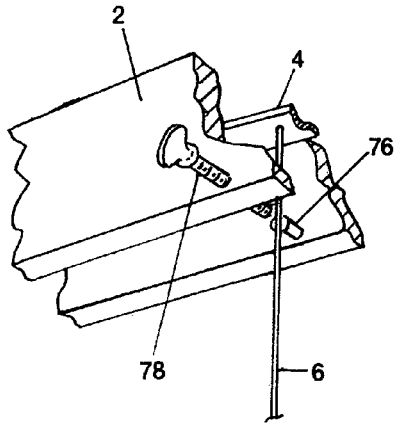
FIG. 13 shows a screw type sharper

A very simple sharping mechanism is shown in FIG. 13, which shows threaded rotating handles, such as a threaded thumbscrew (78), that can be advanced towards it's associated string by screwing it further into it's threaded hole. The end of the thumbscrew will thereby push the string such that the string will eventually be trapped between the end of the thumbscrew and a boss (76) or sharping ledge on the other side of the string. The string will thereby be fretted at this position. FIG. 11 shows a slightly more advanced version of this design, in which the thumbscrew is arranged to run thru clearance holes on each side of the head, and the threading of the thumbscrew is clockwise for half of it's threaded length, and counter-clockwise for the remainder. The thumbscrew passes thru a pair of oppositely-threaded, resiliently mounted fretting plates (87). Rotation of the thumbscrew in one direction causes the fretting plates to advance towards each other, eventually trapping the string between the plates and causing fretting at that point. Rotation of the thumbscrew in the other direction causes the fretting plates to separate, and to eventually be driven against vibration-absorbing material on the inside walls of the head. Note that the screw-thread pitch of these members may be arranged loosely, such that a quarter- or half-rotation of the thumbscrew is sufficient to cause complete actuation of the sharper.

Figure 14:
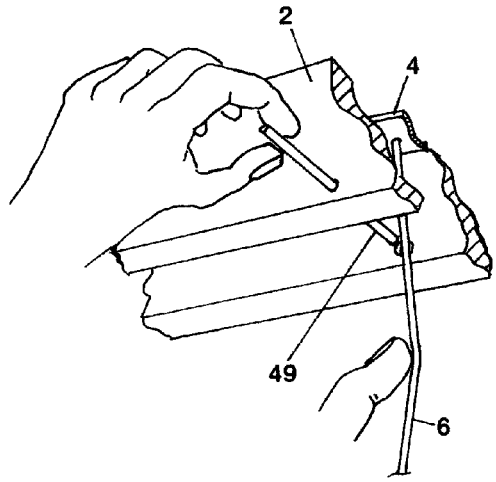
FIG. 14 shows a hand-emplaced pin sharper
Figure 15A:
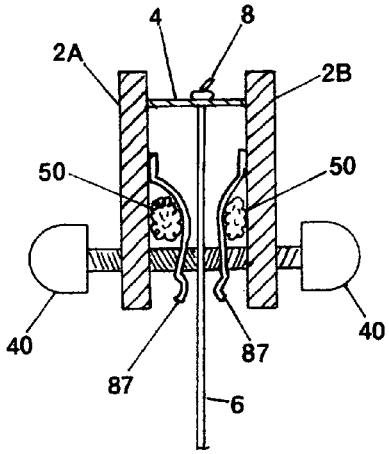
FIG. 15 shows a screw and plate sharper
Figure 15B:
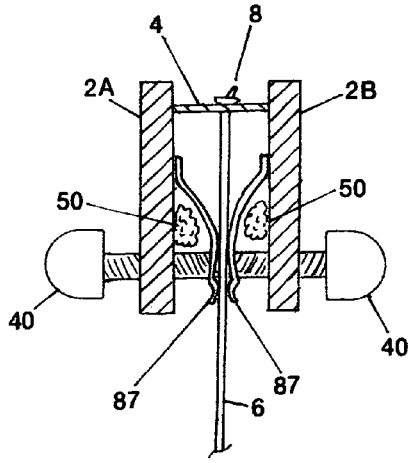

Perhaps the simplest sharper of all is shown in FIG. 14. The harper would push the desired string slightly forward or backwards and simultaneously position a small rigid rod (49) to emplace it in appropriately-located openings, holes, or recesses in the frame. When the string is released, it will rest against, and be fretted by, the inserted fretting rod.

To aid in mass production, with it's attendant lower cost, the planar sharpers shown in FIG. 6, FIG. 7 and FIG. 9 can be punched, cut, or molded as a single strip for the entire harp. The resilience of the sheet material keeps the moveable sections in compression against the non-moving sections, and this keeps the moveable parts from vibrating. FIG. 8 shows a similar concept, except the technology used is bent spring wire or spring metal ribbon.

Figure 16:
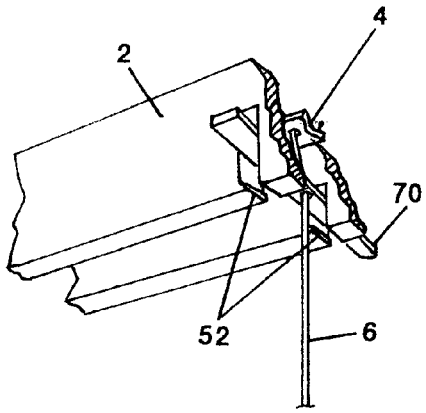
FIG. 16 shows a variable-position sliding sharper

The sliding sharper of FIG. 16 has the benefit of being continuously variable. This feature enables "bent" notes and slurs from one note to another. A detent at either or both ends of the sliding length aids the user in finding an accurate position for the natural and sharped positions. In addition to these two fixed note positions, this type of sharper is unusual (in non-pedal harps) in that, given proper dimensions and detent positions, it can be readily set for any of three positions—natural, sharped, and flatted.

Figure 12A:
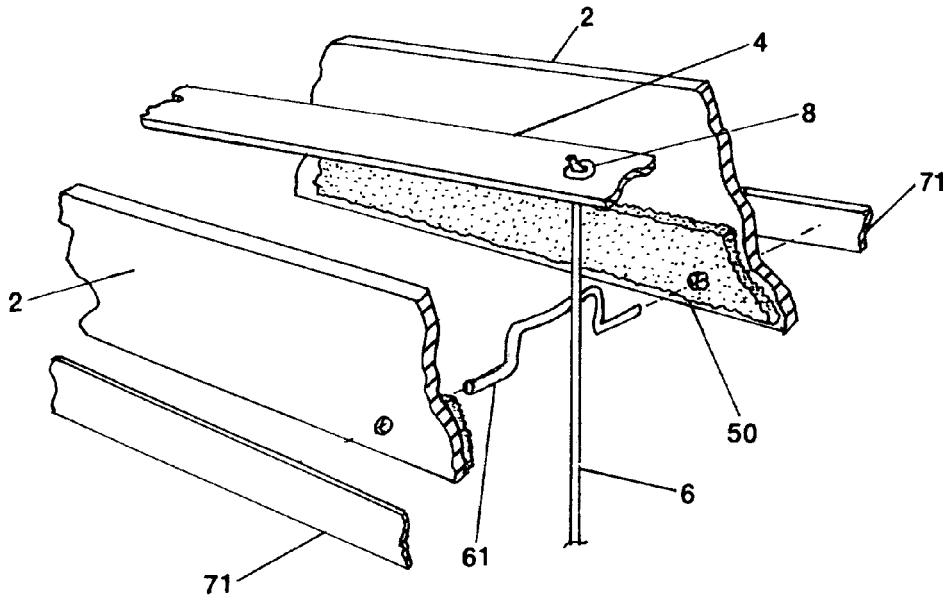
FIG. 12 shows a rotating wireform sharper
Figure 12B:
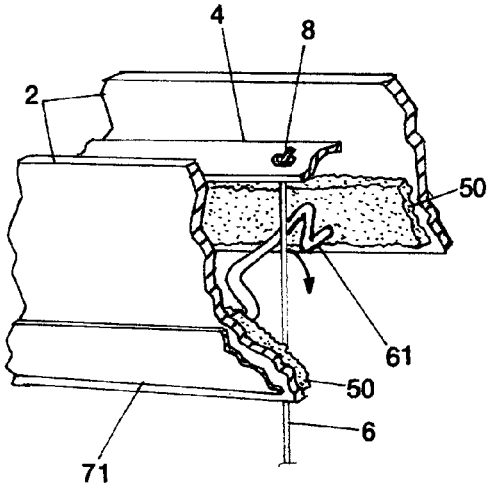
Figure 12C:
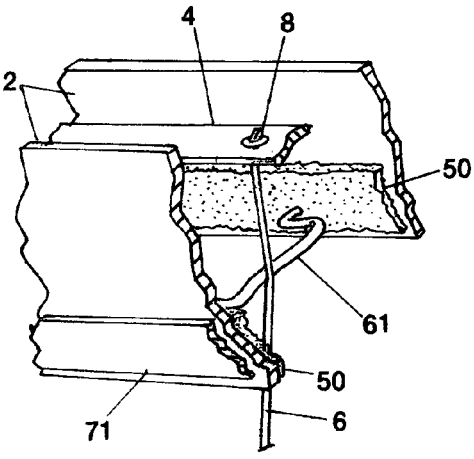

The wireform sharper shown in FIG. 12 is very simple and compact, lending itself to uses where size is an issue, such as in travel harps, etc. The harper merely rotates the wireform (61) sharper into position against the string, or away to allow the string to be unfretted. The sharper may be held in position either by a stop (slightly above the horizontal position of the wireform, so as to firmly snap the sharper into a position) or merely by the friction in the wireform mounting holes and/or the lateral pressure of the vibration-absorbing material (50).

An optional addition to the sharper designs mentioned herein is a means to apply lateral pressure on the upper end of the string, above the fretting point. This increases the pressure on the string, at the fretting point, which further improves the sound of the sharped string. Examples of such pressing means include semi-resilient loops or structures attached to the rotating sharper body that comes into contact with the string when the sharper is actuated. Alternatively, a second rotating member can be geared or connected to the main cam body such that it rotates to contact the string when the sharper is actuated.

FIG. 24 shows a lever-style of sharping mechanism which operates by pulling on a loop of non-stretching cord (85), as it is operated thru it's range of motion. The orientation of the cord loop holes and the pivot point of the anchor cooperate to cause the lever to have two stable resting points, which keep it from vibrating, and a tighter, transitionary position which is unstable. Therefore, the lever system has a bistable "flicking" action that allows for very quick changes by the harp player. In the sharped position, the cord loop pulls on the string to cause it to be fretted against a rod or fret which constitutes a sharping ledge (65). In the unsharped position, the springs act the back of the loop as shown.

FIG. 25 shows a geared or otherwise coupled pair of moveable levers which are shown as pivoting on rods (68). These rollers can be mounted on two axle rods that run underneath and parallel to the bottom of the two head walls. When either lever handle is pushed upwards, the pair of levers both rotate and cause the bosses of the items to squeeze together, clamping the string at the fretting point from both sides. In the unsharped position, these bosses are separated and the string passes by without being fretted by the bosses.

Figure 17:
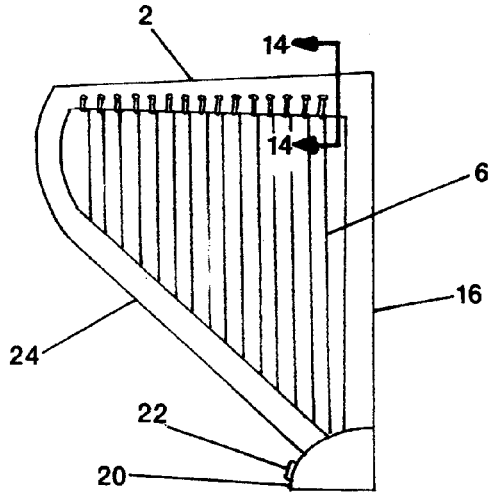
FIG. 17 shows an embodiment of the invention using tubular construction
Figure 18A:
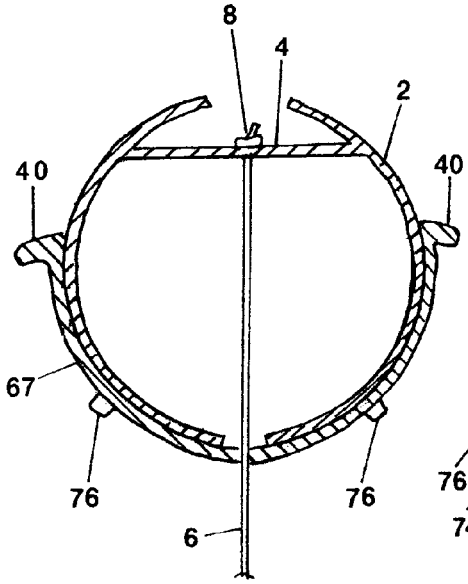
FIG. 18 shows a detail of a sharper for tubular constructed embodiments
Figure 18B:
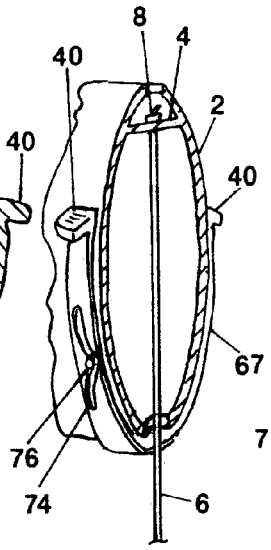
Figure 18C:
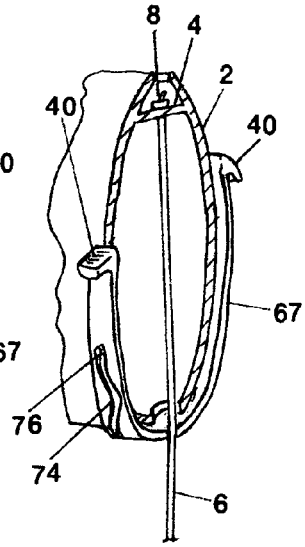

For aesthetic and other reasons, the head of the instrument can be made to have a tubular cross-section. A simple sharping mechanism for this style of construction is shown in FIG. 17. Rings of stiffly resilient material, such as spring sheet metal or hard plastic, are arranged concentric with the head, and positioned either internally or externally. These rings can either be capable of translation along the length of the head, or rotation around the axis of the head, or both. One means of effecting such translation, with resulting fretting of the string, is shown in the FIG. 18. In this example, there is a curved slot (74) cut into the ring, and a boss (76) or post, which is attached to the head, extends into this slot. When the sharper handle (40) is pushed downward, from either side, the curved shape of the slot forces the ring towards the string, resulting in a sharped condition. In the diagrams, this slot and post arrangement exists symmetrically on both sides of the instrument.

In addition to the obvious options available for electronic effects afforded by an electric instrument, there are many optional sound-modifying enhancements that can be considered, due to the unique layout of the instrument of the present invention.

Figure 10:
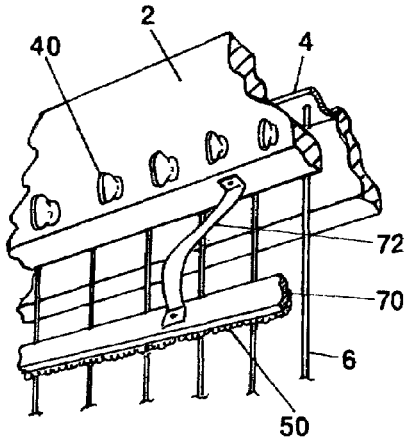
FIG. 10 shows a side-mounted damper

As shown in FIG. 10, a moveable bar (70), faced with vibration dampening material, can be nonrigidly mounted above the playable area of the strings, and below the row of sharper handles (if any), using a nonrigid damper mount (72), so that it can be pushed or held against the strings. In this way, the harper can create short, muffled notes similar to the pizzicato passages played by violinists, etc. In another use of the damper bar, the harpist can play a note and then quickly stifle the sound with the damper. Note that dampers may also be arranged as an interlocked pair, such that the dampers may be actuated from either side. Alternatively, a comb-shaped damper can also be arranged to have it's "teeth" held in a position in the spaces between the strings, or a pass-thru damper (74) can similarly be made with diamond-shape cutouts thru which the strings are passed. By pushing this type of damper towards the plane of the strings, from either side, the strings will be captured within the V-shaped corners of the diamond-shaped cutouts.

Partial dampers can also be employed, in which the vibration-dampening material is permanently or temporarily shaped so as to leave some strings undamped while allowing other strings to drone. This could be of particular advantage when playing music that was originally written for a droning instrument, such as the bagpipe.

In an acoustic harp, some of an instrument's particular sound is a result of the mechanical and resonating qualities of the soundboard and resonator box. This can be approximated in the current invention by surrounding the diagonal arm with a thin-walled resonator box that can be very similar to that of a traditional celtic harp. The resonant sounds of this structure can either be detected by additional pickup wire mounted in or near the resonator, or an internal microphone can be used for the purpose. In either case, it may be advantageous to amplify or shape the resonator signal before adding it to the harp output signal. In this way, the effect of having a large resonator can be somewhat simulated with a much smaller one. To enhance portability of the instrument, such a resonator can be made to collapse for storage, or even to be removed from the diagonal arm by releasing one or more screws or similar means of releasable attachment. Note that such a resonator can also be used in lieu of electrical amplification in relatively quiet settings, such as for personal practice.

FIG. 22 shows an exploded, simplified view of a resonator box (80) which can be attached to the diagonal arm of the instrument using hand-tightenable wing nuts. FIG. 23 shows another type of resonator, which eliminates the box concept and replaces it with a stretched or flexed membrane. In the example shown, the flexed resilient sheet is lightweight, capable of flat storage and eliminates the need for hinges. Such a resonator also provides an aesthetic alternative to the more traditional box-like resonator of FIG. 22.

New types of resonance enhancements are possible due to the layout of the present invention. For example, as shown in FIG. 21, to enhance sympathetic vibrations among the strings it may be desirable to replace the rigidly mounted lower fret loops with a openings, holes, or recesses in one or more nonrigid members. This perforated resonating member (22) may be made from any of several materials, such as plastic, wood, or metal sheet. Because this member has a measure of mechanical freedom and the ability to propagate acoustic energy easily along it's length, such a perforated resonating member will have the tendency to set up sympathetic vibrations among harmonically related strings of the instrument.

CONCLUSION, RAMIFICATION, AND SCOPE

An alternative convenient form of string mount consists of a set of rods or posts, one for each string. Each rod or post may have a thru-hole to pass the string thru. The rods or posts are mounted approximately perpendicularly to the strings. The strings can either pass thru the center hole, or simply be wrapped and tied around the post, as desired. In applications that utilize the thru hole, it can be advantageous to have the hole drilled at a non-perpendicular orientation relative to the strings of the instrument. In this way, the tension of the strings causes them to be held to one side of the hole, thereby reducing the tendency of plucked strings to buzz against the sides of any oversized holes.

In a typical single-course instrument, the most common string counts are between 12 and 36. This force is taken up by the front column and the back column. Since the present invention is notable in arranging these forces along the centerline of the harp, and not off-center as is the case with prior art electric harps, either of these columns may be omitted as long as the material of the harp body is sufficiently strong to accept the stress. One skilled in the art would see that various cantilevering methods and/or tensioning cables could afford some very dramatic and possibly practical designs based on this aspect of the present invention.

The present invention lends itself to adaptation to both cross-strung and triple-strung alternative embodiments. Such harps may have more than 60 strings, commonly. In such harps, and in metal-strung harps (which experience greater string tension), additional columns can be used to provide the needed strength, and these columns would experience only compression, as opposed to the more difficult combination of compression and torsion that would be the case with the off-center stresses in the prior art electric harps. The additional columns can either be placed so as to minimize interference with the player's hands, or they can be thin, small columns placed essentially in among the strings. In the case of cross-strung and triple strung harps, positioning the columns directly in the center line of the instrument provides the best "hiding" of the columns, since these types of harps are typically played in such a way that player's hands actually avoid the center line of the harp. The centralized stresses of the instrument of the present invention can make use of this central region for supports, better than electric harps of the prior art with their attendant torsional forces.

At the treble end of the pickup wire, where it essentially intersects the back column, the end of the coaxial pickup wire is either simply cut, or it can be connected to a grounding or hum-reducing circuit or structure. This end of the pickup wire can also be left with additional length so that it can be mechanically coupled to the back column, or threaded back thru the lower fret loops of some of the treble strings (effectively doubling the signal from these smaller strings) or used in any of several other ways to couple additional acoustical signal into the pickup wire. An additional use for the upper end of the pickup wire is to allow the direct connection of a small microphone to the pickup wire. This microphone, with or without a preamp and/or volume control, can be used either as a vocal pickup for the harper's use, or as a means of picking up additional acoustic resonances from the head of the instrument, or both. Whether the upper end of the pickup wire is used for additional acoustic inputs, another useful addition to this end of the wire is to place a muting switch within easy access by the harper. This switch shorts the coaxial pickup wire to it's shield, when actuated, causing the output of the instrument (and any connected microphone) to go to zero. This feature could be helpful between songs, for example, during which time the harp may accidentally be bumped and otherwise pick up extraneous noises.

A band-pass filter (passing only the desirable range of audible frequencies) can be inserted between the lower end of the pickup wire and the electrical connector. This would allow the pickup wire to serve in a few more ways. In this condition, the pickup wire can be used to provide DC power to electronic items near the head, such as aesthetic and/or functional lighting of any color, electronic active mixers and effects controls near the head, breath sensors as musical inputs, and to provide "phantom power" for dynamic microphones, for example. Other applications making use of a bandwidth-limited output jack can include digitally-controlled volume/effects controls and displays mounted near the head. In this way, a complete digital control panel, metronome, etc, can be at ready access to the harper, and high-frequency electronic control signals can be used to connect between the control panel etc., and the devices mounted near the electrical connector. This minimizes the wiring needed along the length of the diagonal arm, which is especially desirable in embodiments of the present invention constructed of clear materials, since such additional wiring would take away from the visual simplicity of the design.

The layout of the preferred embodiment of the present invention provides for a mechanically protected space within the head of the instrument. This improves the practicality of incorporating tuned string mounting elements. These can take the form of tuning forks, tuned pipes or rods, tuned air columns, or tuned taut strings. As an option, it may be musically advantageous to tune each tuned string mount to a pitch which is harmonically related to it's given string, by an interval that can be unison, octave, suboctave, fifth, etc to achieve a harmonious result. Alternatively, the tuned string mounts can be set for a few cents off of the string frequency, resulting in a chorused effect.

Since only a small amount of vibrational energy is imparted to the tuned string mount, the audible effect of the mounting scheme may be obscured by the much greater output of the vibrating strings. To counter this effect and to give the musician greater freedom in tailoring the instrument's sound, an additional microphone or transducer can be used to preferentially pick up the sounds from the resonant string mounts. Alternatively, the upper end of the pickup wire can be brought into contact with the string mounts and thereby the resonant string mount sound would be mixed with the string signal in a passive way.

Interval-coupled strings: At either ends of the string's vibrating length, the acoustic energy of a vibrating string can be selectively coupled to it's harmonically related neighbors. At the head (upper) end of the strings, this can be done by implementing up to eight individual string mounts (for octave-interval coupling), which can be positioned one above the next with a small gap between each. Each of the string mounts is drilled so as to accept only the desired strings. In the octave-coupled unit, for example, the top string mount would be drilled to mount all of the "C" strings on it, while the next string mount below it would be drilled to mount all of the "D" strings, etc. Each string mount would be cut away to allow access and unhampered movement to all of the strings not mounted on it. Each string mount would be mounted in a manner that optimizes internal vibration coupling from string to string. The is effect increases the power of harmonic and subharmonic signals for each string that is plucked, resulting in a fuller, richer sound. Note that the sharping mechanisms would have to be arranged to take into account the variations in string length and starting positions caused by such a mounting method.

A similar interval-resonant mounting system can be used on the lower end of the strings. This can be accomplished by replacing the individual lower fret loops with ganged sets of loops. In the octave-interval example, one ganged set of loops would be positioned to accept all of the "C" strings, while the next set of loops would accept all of the "D" strings, and so forth. Within a ganged set of loops, vibrational energy is coupled from a plucked string to all of the other strings of that connected ganged set. The ganged loop sets are connected to the diagonal arm in a manner that facilitates this energy transfer.

Preferably, the instrument can incorporate mechanical means by which the instrument can be held comfortably by players of various sizes and position preferences. The prior art contains many good methods of supporting a harp in various positions, including straps, small stools, and mechanically attached braces which rest on the lap of the seated player.

The unusual shape of the present invention affords some new and improved alternative support methods. Due to the relative thinness of the design, and the potential absence of the resonator box, strips and clamps can be used on the diagonal arm more simply than was possible with traditional acoustic instruments. FIG. 1 identifies one possible location for a thru hole (25) in the diagonal arm, and one or more threaded holes (27 and 29) can further facilitate attachment of stabilizing devices. One skilled in the art can devise numerous variations of clamped, strapped, and combination clamped and strapped means of supporting the instrument as a "lap harp". The thinness of the instrument to enables a doughnut-shaped plate to be used as a prop for lap use of the instrument. In one version, the thickness of the plate is what provides the lateral support for the harp, but alternatively the plate could be made thinner if vertical members are added to enhance lateral stability.

It will be obvious to one skilled in the art that elastic straps, hook-and-loop fasteners, foams, rubbers, and threaded devices are among the materials that can be employed in these supporting devices.

T-slotting of the diagonal arm and/or the front column are other options afforded by the lack of a resonator box. Such T-slots can provide convenient points of attachment for supporting devices and other accessories.

Accordingly, the reader will see that, according to the invention, I have provided a harp design which is simultaneously reliable, lightweight, low in cost, hum-free, feedback-resistant, and reproducible in quantity without excessive requirements of skill or workmanship While the above description contains many specificities, these should not be construed as limitations on the scope of the invention, but as exemplifications of the presently preferred embodiments thereof. Many other ramifications and variations are possible within the teachings of the invention. Thus the scope of the invention should be determined by the appended claims and their legal equivalents, and not by the examples given.

What is claimed is:

1. An electrified musical instrument comprising:

a) a plurality of tensioned, freely-vibrating strings b) an electrically shielded coaxial piezoelectric cable c) a frame arrangement with a plurality of openings or holes through which said piezoelectric cable passes, and through which each of said strings individually passes, whereby acoustic energy is transferred into said piezoelectric cable, resulting in a reliable electronic musical instrument that is essentially free of hum.

2. The instrument of claim 1 wherein some or all of said openings or holes within the frame arrangement are made within one or more non-rigidly mounted members whereby vibration may be coupled among said strings.

3. The instrument of claim 1 additionally comprising a set of rod or post shaped string mounts with thru-holes or recesses positioned at such an angle as to cause said strings to deviate from a straight line, such that string tension causes said strings to be held firmly against one exiting edge of each of said thru-holes or recesses, whereby said exiting edges are made to function as end nodes of said strings when they are in vibration.

4. An electrified musical instrument comprising:

a. a plurality of tensioned, freely-vibrating strings b. an electrically shielded coaxial piezoelectric cable c. a frame arrangement with a plurality of openings or holes through which said piezoelectric cable passes, and through which each of said strings individually passes, whereby acoustic energy is transferred into said piezoelectric cable;

d. one or more moveable sharping members which can be selectively positioned by the operator to contact and constrain the motion of one or more of said strings, thereby creating a nodal point in said string's vibrating length, resulting in a reliable electronic musical instrument that is essentially free of hum and that further has the ability to raise the pitch of any or all of said strings.

5. The instrument of claim 4 wherein said moveable sharping members are restrained from vibration thru the use of compressed resilient materials.

6. The instrument of claim 4 wherein said moveable sharping members are restrained from vibration thru the use of magnetic materials.

7. The instrument of claim 4 wherein said moveable sharping members are brought into contact with said string by means of threaded rotating handles.

8. The instrument of claim 4 wherein said moveable sharping members are resilient and are maintained in either of their two stable positions by their resilience.

9. The instrument of claim 4 wherein said moveable sharping members can be hand-emplaced in appropriately-located openings, holes, or recesses in the frame to cause said sharping members to contact said strings.

10. The instrument of claim 4 wherein said moveable sharping members have a suitable opening, hole, or recess which allows said string to pass freely in one position, or to be contacted by said moveable sharping member when it is rotated and/or translated by the operator, thereby causing said sharping member to contact said string.

11. The instrument of claim 4 wherein said moveable sharping members are capable of travel parallel to said strings so that the operator may position said sharping member at any desired and/or predetermined location along said string, whereby the operator may alter the pitch of said string to a greater or lesser degree by appropriate positioning of said sharping member along it's range of travel.

12. The instrument of claim 4 additionally comprising a semi-resilient loop or structure which is arranged to provide lateral pressure to said string, above the fretting point, when the sharping member is moved by the operator to contact said string, whereby the rigidity of the fretting point is enhanced.

13. The instrument of claim 4 wherein said moveable sharping members are arranged as pairs of rotating or hinged members that are geared or otherwise coupled to each other such that the movement of one a pair of said members causes movement in the other member of said pair, and this motion of said pair of members causes the selectable opening and closing of a resulting opening, hole, or recess such that said string may pass freely in one position, or be contacted by one or both members of said pair of members when it is rotated and/or translated by the operator into the other position, whereby the operator may alter the pitch of said string.

14. The instrument of claim 4 with the addition of a handle, button, or lever, whereby said handle, button, or lever causes a pitch change in more than one string.

15. The instrument of claim 4 wherein said frame arrangement and/or said sharping members further comprise bumps or indents which can be used as detents to the rotation or translation of said sharper members, whereby the operator is aided in switching between predetermined positions of said sharping members.

16. An electrified musical instrument comprising:

a. a plurality of tensioned, freely-vibrating strings b. an electrically shielded coaxial piezoelectric cable c. a frame arrangement with a plurality of openings or holes through which said piezoelectric cable passes, and through which each of said strings individually passes, whereby acoustic energy is transferred into said piezoelectric cable;

d. one or more fixed sharping ledges attached to said frame arrangement e. one or more moveable members which can alter the path of one or more of said strings so as to selectably cause contact of said string with one or more of said sharping ledges, resulting in a reliable electronic musical instrument that is essentially free of hum and that further has the ability to raise the pitch of any or all of said strings.

17. The instrument of claim 16 wherein said moveable members are loops or partial loops which can be selectably switched by the operator so as to pull one or more of said loops or encircling members strings into or out of contact with said sharping ledge, causing said sharping ledge to contact and constrain the motion of one or more of said strings, thereby creating a nodal point in said string's vibrating length whereby the pitch of said string may be raised when said string is in contact with said sharping ledge.

18. The instrument of claim 16 wherein said moveable members can be selectably switched by the operator so as to push one or more of said strings into or out of contact with said sharping ledge whereby the pitch of said string may be raised when said string is in contact with said sharping ledge, causing said sharping ledge to contact and constrain the motion of one or more of said strings, thereby creating a nodal point in said string's vibrating length whereby the pitch of said string may be raised when said string is in contact with said sharping ledge.

19. An electrified musical instrument comprising:

a. a plurality of tensioned, freely-vibrating strings b. an electrically shielded coaxial piezoelectric cable c. a frame arrangement with a plurality of openings or holes through which said piezoelectric cable passes, and through which each of said strings individually passes, whereby acoustic energy is transferred into said piezoelectric cable;

d. One or more moveable acoustic panels or membranes acoustically coupled to said frame, resulting in a reliable electronic musical instrument that is essentially free of hum and that further can be reduced in size for storage and that also has the ability to produce a non-electronic audible output.

20. The instrument of claim 19 wherein said moveable acoustic panels or membranes are a flexible sheet.

21. The instrument of claim 19 wherein said moveable acoustic panels or membranes may be folded or positioned to at least partially enclose said strings, whereby said strings may be protected while in storage.

22. The instrument of claim 19 wherein said moveable acoustic panels or membranes comprise a box-like structure of thin rigid panels, said box-like structure being either rectangular or non-rectangular in cross-section.

* * * * *